United States Patent [19]

Arendt

[11] 4,127,167

[45] Nov. 28, 1978

[54] LUBRICATOR FOR MOVING WELL EQUIPMENT THROUGH FLOW CONDUCTOR

[75] Inventor: Henry P. Arendt, Dallas, Tex.

[73] Assignee: Otis Engineering Corporation, Dallas, Tex.

[21] Appl. No.: 817,514

[22] Filed: Jul. 21, 1977

[51] Int. Cl.[2] ..... E21B 19/16

[52] U.S. Cl. ..... 166/85; 166/315

[58] Field of Search ..... 166/77.5, 85, 77; 254/30

[56] References Cited

U.S. PATENT DOCUMENTS

| | | | |
|---|---|---|---|
| 1,586,923 | 6/1926 | Townsend | 166/77 |
| 2,721,614 | 10/1955 | Simmons | 166/77 |
| 3,463,247 | 8/1969 | Klein | 166/77.5 |
| 3,797,570 | 3/1974 | Leutwyler | 166/77 |

*Primary Examiner*—Ernest R. Purser

*Attorney, Agent, or Firm*—Vinson & Elkins

[57] ABSTRACT

Disclosed is a rod-type lubricator for moving well equipment through a flow conductor. A piston controls movement of the lubricator rod. The rod includes an equipment handling segment and reach segments. As many reach segments as desired may be employed. The distance through which the well equipment may be moved is greater than the stroke of the piston. This abstract is neither intended to define the invention of the application which, of course, is measured by the claims, nor is it intended to limit the scope of the invention in any way.

10 Claims, 6 Drawing Figures

LUBRICATOR FOR MOVING WELL EQUIPMENT THROUGH FLOW CONDUCTOR

BACKGROUND OF THE INVENTION

1. Field of the Invention

This invention relates to a lubricator for moving well equipment through a flow conductor.

2. The Prior Art

For various reasons, plugs or other well tools are positioned within well flow conductors prior to assembly of an underwater wellhead. Upon or after completion of the underwater wellhead, the plugs are removed to premit subsequent fluid flow through the conductor.

Some underwater wellheads are assembled within a submerged and enclosed work chamber. The work chamber is formed on the guide base of the underwater wellhead and provides a limited space within which personnel and equipment may maneuver. A portion of the underwater well flow conductor extends into the work chamber. Well equipment is run several feet through the flow conductor to retrieve the well plug therefrom.

Several factors prevent the use of conventional methods for retrieving such a well plug. First, the limited space inside the work chamber will not accommodate conventional wireline or pumpdown lubricators. Second, wireline equipment cannot develop the large downward forces required to unlock the well plug from the flow conductor. The distance between the well plug and the end of the flow conductor is too short for wireline equipment to develop those forces. Third, at this stage of the completion of the underwater well, the underwater wellhead is not fully equipped with pumpdown flow lines and related equipment. Conventional pumpdown operations therefore cannot be used to retrieve the well plug.

Rod-type lubricators have been used to run retrieval equipment. One form of rod-type lubricator has an elongate cylinder, a piston movable in the cylinder, and a single element rod. One stroke of the piston is designed to move the rod and the attached retrieval equipment a distance sufficient to reach the well plug. The rod extrudes longitudinally beyond the cylinder prior to the piston stroke. The stroke of the piston and the length of the rod are both greater than the distance between the end of the flow conductor and the well plug. The plugs are generally approximately 4 feet from the end of the flow conductor. The lubricator and extruded rod therefore have a longitudinal dimension in excess of 8 feet. Such a rod-type lubricator requires too much longitudinal space for some of the underwater pressure vessels presently utilized. When the reach rod extrudes, its end can engage the wall of the work chamber. If the piston should fail, the rod could be pushed through the chamber wall. The integrity of the chamber would be destroyed and the lives of the personnel therein endangered. Another form of rod-type lubricator employs a segmented rod. Otherwise, it is similar to the first form. Again, a single stroke of the piston moves the rod and the retrival equipment a distance sufficient to reach the well plug. During controlled movement of the piston, the rod segments may be added or removed as desired. However, failure of the piston could result in the rod being extruded. Under such circumstances, the entire length of the rod would extrude out of the lubricator. Due to space limitations in the work chamber, if that occurred, the end of the rod would engage and rupture the wall of the work chamber.

OBJECTS OF THE INVENTION

An object of this invention is to provide a shorter rod-type lubricator then is presently available without shortening the distance through which well equipment may be moved by the lubricator.

Another object of this invention is to increase the distance through which a rod-type lubricator can move well equipment while shortening the longitudinal length of the lubricator.

Another object of this invention is to provide rod-type lubricator wherein the lubricator rod is prevented from extruding beyond the lubricator housing to thereby protect the integrity of a surrounding underwater work chamber in the event that the lubricator piston fails.

Another object of this invention is to provide a shorter rod-type lubricator then is presently available and have a section of the lubricator housing be removable so that the lubricator may be further shortened, if desired.

These and other objects and features of advantage of this invention will be apparent from the drawings, the detailed description, and the appended claims.

BRIEF DESCRIPTION OF THE DRAWINGS

In the drawings wherein like numerals indicate like parts and wherein an illustrative embodiment of this invention is shown.

DETAILED DESCRIPTION OF THE PREFERRED EMBODIMENT

Figure 1:
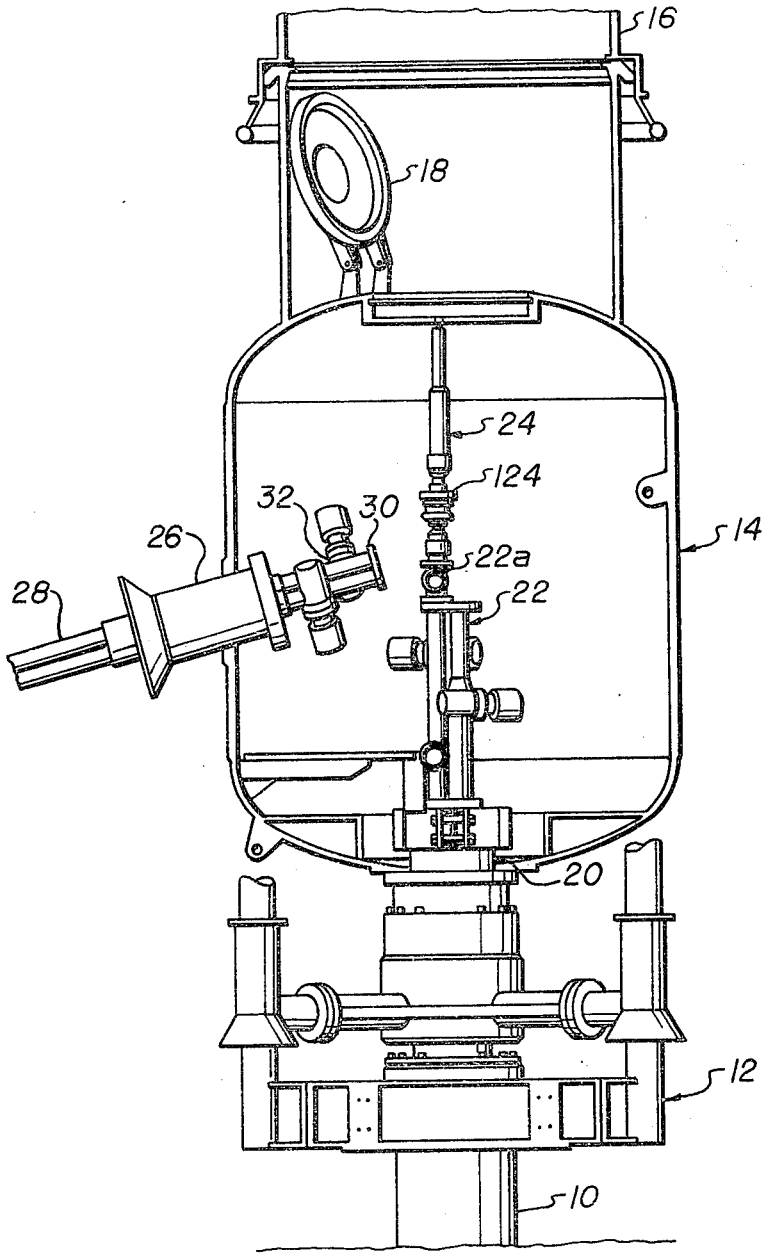
FIG. 1 is a view partly in elevation and partly in section of an underwater well installation wherein the rod-type lubricator of this invention may be utilized.

FIG. 1 illustrates an underwater wellhead installation prior to the hook-up of the subsea tree and flow lines.

A surface casing 10 extends upwardly from the ocean floor (not shown). Near the upper extremity of the surface casing 10 is formed a guide base 12. A work chamber 14 is secured to the upper end of the surface casing 10 above the guide base 12. Sea water is evacuated from the work chamber 14. The chamber 14 is filled with air at atmospheric pressure. Personnel work within the chamber 14 to establish the connections for the underwater tree and the flow lines. Personnel may be lowered to the work chamber 14 within a service capsule 16 (only a portion of which is shown). A hatch 18 of the work chamber provides access between the service capsule 16 and the work chamber 14.

The upper end of the surface casing 10, within the work chamber 14, is provided with a casing head 20. The normal tubing hanger (not shown) is positioned within the casing head 20. From the tubing hanger, the well tubing strings (not shown) hang downwardly and extend through the surface casing 10 into the well.

While the well was being drilled and tested, a blowout preventer stack would have been positioned on top of the casing head 20. After testing, the well was killed. Well tools, such as plugs, were positioned within the bores of the tubing strings. The blowout preventer stack was removed. To prepare the well for production, the underwater tree, generally indicated at 22, is attached to the casing head 20. However, the well plug(s) still are positioned within the bore(s) of the tubing string(s). The plug(s) must be removed prior to production. To remove a well plug from the bore of the tubing string, a lubricator 24 is connected to the tree 22. The lubricator 24 moves retrieval equipment through the tree 22. The lubricator 24 is operated to manipulate the retrieval equipment so that the plug is unlatched from the tubing string. Thereafter, the lubricator 24 withdraws the retrieval equipment and plug from the tree 22.

A bull nose 26 extends through the wall of the work chamber 14. One end of a flow line bundle 28 is pulled to the bull nose 26 and is received therein. Within the work chamber 14, personnel will connect a flow line loop between the end of the flow line bundle 28 and the tree 22. However, a plug (not shown) has been positioned within the end of the flow line bundle 28 to prevent trash or sea water from entering the flow lines. The plug is removed prior to connection of the flow line loop. To do so, a lubricator 24 may be attached to one end 30 of a valve block 32 formed on the bull nose 26.

Space limitations within the work chamber 14 and the variable distance between the end of the lubricator 24 and the location of the well tool or plug within the respective well flow conductor, impose seemingly contradictory criteria for a lubricator 24. The space limitations within the work chamber 14 limit the length of the lubricator 24. However, the lubricator 24 must move well equipment between its end and the location of the landed tool or well plug. That distance through which the well equipment is moved may be greater than the length of the lubricator 24. If the lubricator piston fails, well fluid pressure may tend to extrude the lubricator rod. Such uncontrolled extrusion of the rod should not danger the integrity of the work chamber 14. Additionally, the lubricator 24 preferably includes a removable section to permit the lubricator's length to be further reduced.

Figure 2A:
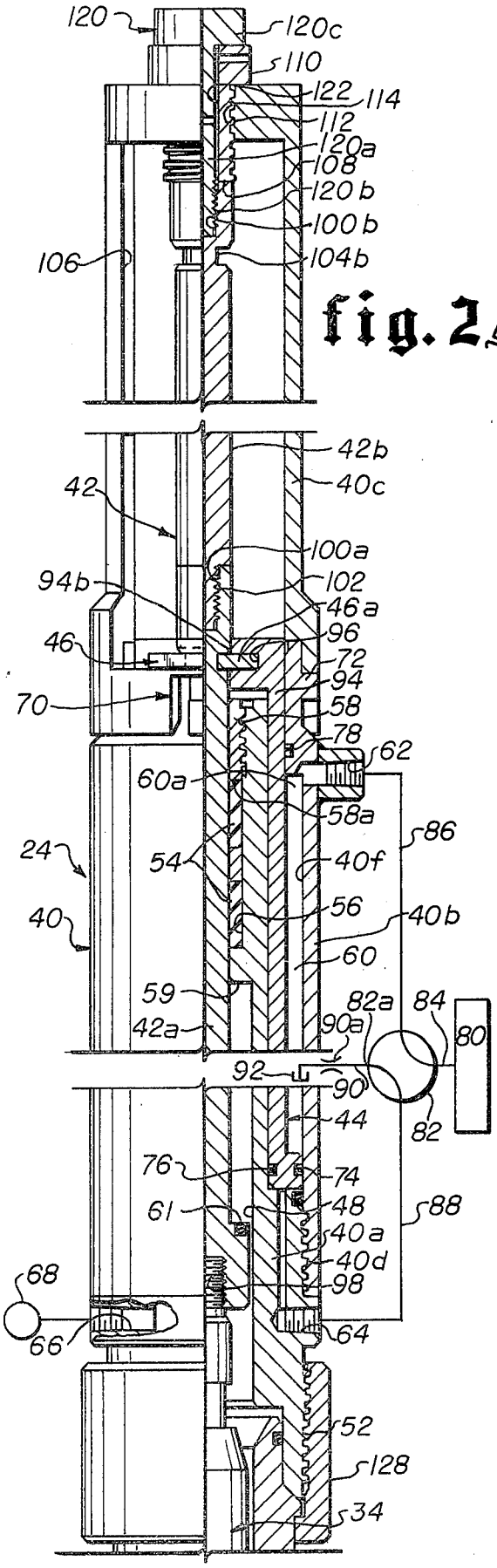
FIGS. 2A and 2B are continuation quarter-sectional views of the lubricator and a portion of the well installation of FIG. 1.
Figure 2B:
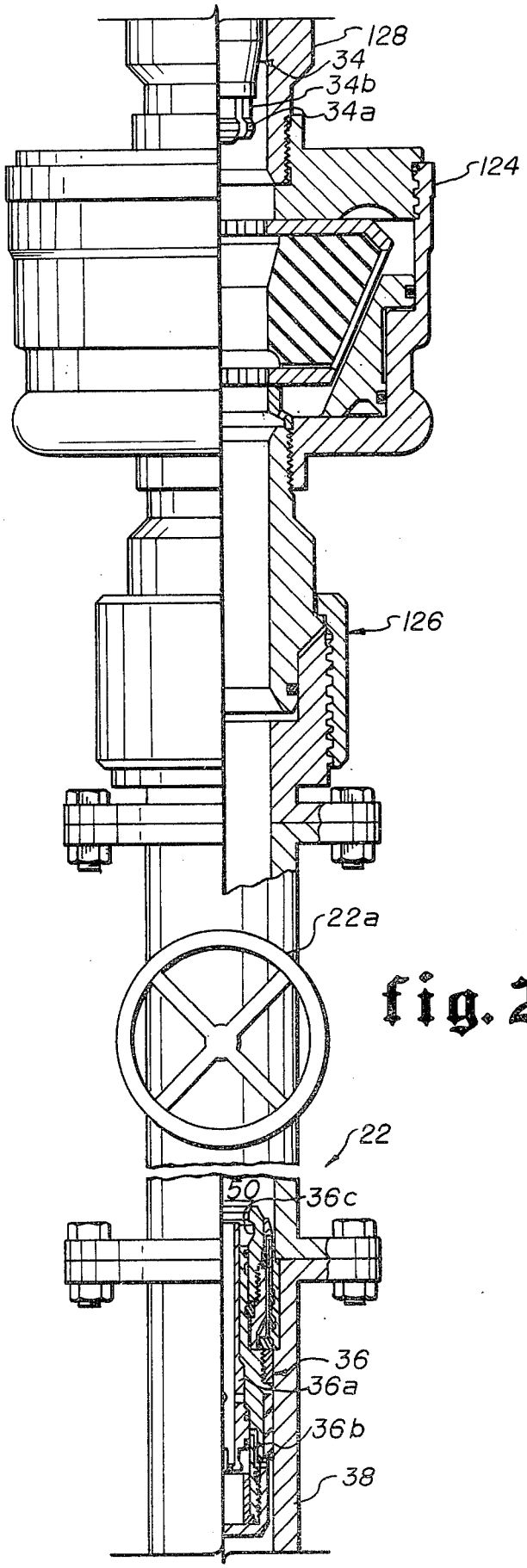

In FIGS. 2A and 2B, the lubricator 24 is connected to the top of the underwater tree 22 (only a portion of which is shown in FIG. 2B). The lubricator 24 will move retrieval equipment 34 through the tree 22. The retrieval equipment 34 will engage and retrieve the tool 36. The tool 36 is landed and latched within a well flow conductor 38 and positioned below the base of the tree 22. The retrieval equipment 34 and tool 36 may be structured in accordance with the disclosure of copending application Ser. No. 786,380 filed Apr. 11, 1977.

The lubricator 24 includes housing means 40, rod means 42, piston means 44, and coupling means 46. Rod means 42 is moved through the lubricator housing means 40, and through the well flow conductor 38, is response to movement of piston means 44. Coupling means 46 selectively renders rod means 42 moveable with piston means 44. Coupling means 46 is disengageable from rod means 42. Rod means 42 is held stationary with respect to housing means 40 when coupling means 46 is disengaged therefrom. Piston means 44 may then be stroked between its two extreme positions without moving rod means 42. Coupling means 46 is thereafter re-engaged with rod means 42 and again renders rod means 42 movable with piston means 44. Additionally, the length of rod means 42 is varied by the addition or subtraction of reach segments. The rod means 42 may therefore extend between the lubricator 24 and any desired depth in the well flow conductor 38. In such manner, the retrieval equipment 34 is moved the required distance.

Lubricator housing means 40 has bore means 48 extending longitudinally therethrough. When housing means 40 is attached to a well installation, such as to the tree 22, bore means 48 communicates with and is aligned with the flow path 50 through the well flow conductor 38. Housing means 40 includes means, such as the threads 52 illustrated, with which it is attached to the well installation or tree 22.

Rod means 42 moves longitudinally through bore means 48 and into the flow path 50 of the well flow conductor 38. To prevent well fluids from escaping from the flow path 50 through the lubricator 24, packing means 54 seals between housing means 40 and rod means 42. Inwardly facing recess means 56 is formed along a portion of bore means 48 and receives packing means 54. Adjusting nut means 58 defines one end of recess means 56 with its downwardly facing surface 58*a*. The longitudinal confinement of packing means 54 within recess means 56 is adjusted by moving adjusting nut means 58 longitudinally with respect to housing means 40.

If packing means 54 should fail, the lubricator 24 includes a back-up sealing system. The back-up sealing system, when rendered effective, will prevent well fluids from escaping through the lubricator 24 from the flow path 50. The back-up sealing system is rendered effective when rod means 42 is fully extruded. Below recess means 56, a downwardly facing internal annular shoulder 59 is formed on housing section 40*a*. The shoulder 59 defines a portion of bore means 48. Rod means 42 carries seal means 61, such as the O-ring illustrated. When rod means 42 is fully extruded, seal means 61 sealingly engages shoulder 59 and seals between rod means 42 and housing means 40.

Housing means 40 forms longitudinally extending chamber means 60. Piston means 44 is disposed within chamber means 60 and moves longitudinally therein to move rod means 42. The illustrated chamber means 60 is annular and is formed within housing means 40 concentrically around bore means 48. To form bore means 48 and chamber means 60, housing means 40 includes an inner sleeve or inner housing section 40*a* to which is connected, as at threads 40*d*, a cylindrical body or outer housing section 40*b*. The outer wall 40*e* of inner housing section 40*a* defines the inner cylindrical surface of chamber means 60. The inner wall 40*e* of section 40*b* defines the other cylindrical surface of chamber means 60.

Hydraulic fluid is admitted to and removed from chamber means 60 via port means extending through housing means 40 and opening into chamber means 60. Fluid is admitted to one portion of chamber means 60 on one side of piston means 44 and removed from another portion of chamber means 60 on the other side of piston means 44 to move piston means 44. Two port means are provided. First port means 62 opens into one portion 60*a* of chamber means 60 which portion will be on one side (e.g., above) of piston means 44 throughout the entire extent of longitudinal movement of piston means 44. Second port means 62 opens into another portion 60*b* of cylinder means 60 which portion will be on the other side (e.g., below) of piston means 44 throughout the entire extent of longitudinal movement of piston means 44.

Housing means 40 also includes third port means 66 extending therethrough and opening into bore means 48 between packing means 54 and connecting means 52. Gauge means, schematically indicated at 68, is preferably connected to port means 66. Guage means 68 provides an indication, at all times, of the pressure of fluids confined within bore means 48.

Housing means 40 also includes a support section 40*c*. During operation of the lubricator 24 a portion of rod means 42 extends along and within the support section 40*c*. The support section 40*c* enables that portion of rod means 42 to be supported and controlled by other components of the lubricator 24. However, the support section 40*c* may be disconnected from the remaining portion of the lubricator 24. Normally, the support section 40*c* of housing means 40 is interconnected with the other housing sections. L-slots 70 and lugs 72 interconnect the support section 40*c* and the other housing sections. That interconnecting means permits the segment section 40*c* to be readily removed from the remaining portion of the lubricator 24. The illustrated L-slot means 70 are formed in the support section 40*c*. They include a longitudinally extending portion 70*a* and a circumferentially extending portion 70*b*. Lug means 72 are formed on the exterior surface and in close proximity to one, upper, end of housing section 40*b* (see FIG. 5).

Piston means 44 is disposed within chamber means 60 and is longitudinally movable with respect to housing means 40. Pressurization of one portion 60*a* of chamber means 60 moves piston means 44 in one direction to a first extreme position (see FIG. 2AO. Pressurization of another portion 60*b* of chamber means 60 moves piston means in the other direction to a second extreme position (see FIG. 3). The illustrated piston means 44 is annular and is disposed concentrically within lubricator housing means 40 around inner housing section 40*a*.

Seal means 74 and 76 carried by piston means 44 and seal means 78 carried by housing means 40 seal between piston means 44 and housing means 40. Seal means 74 and 78 seal between piston means 44 and outer housing section 40*b*. Seal means 76 seals between piston means 44 and inner housing section 40*a*. The difference between the seal affective areas of seal means 74 and 78 is acted upon by the pressure of fluid within the one portion 60*a* of chamber means 60. That pressure tends to move piston means 44 in one direction towards its first extreme (FIG. 2A) position. The difference between the seal affected areas of seal means 74 and 76 is acted upon by the pressure of fluid within the other portion 60*b* of chamber means 60. That pressure tends to move piston means in a second direction towards its second extreme (FIG. 3) position.

Figure 3:
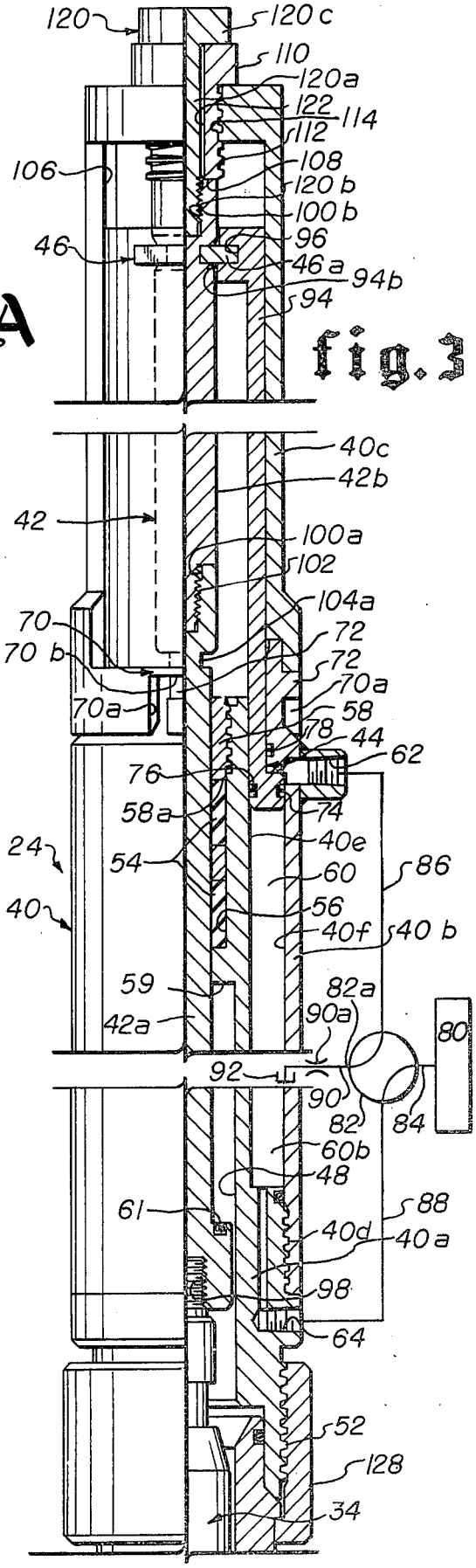
FIG. 3 is a view corresponding to FIG. 2A showing another operative position of the lubricator.

A hydraulic control system for selectively admitting fluid into the one portion 60*a* of chamber means 60 while removing fluid from the other portion 60*b* of chamber means 60 and vice versa is illustrated schematically in FIGS. 2A and 3. Source means 80 provides pressurized hydraulic fluid. The pressurized hydraulic fluid communicates between source means 80 and four-way valve means 82 through conduit means 84. Two conduits 86 and 88 communicate between four-way valve means 82 and the first and second port means 62 and 64 of the lubricator 24, respectively. Another conduit 90 communicates between four-way valve means 82 and a tank or reservoir 92. Four-way valve means 82 is movable between first and second positions. In its first position (see FIG. 2A) pressurized hydraulic fluid communicates between source means 80 and first port means 62. In that manner, pressurized hydraulic fluid is admitted into the one portion 60*a* of chamber means 60 on one side of piston means 44. At the same time, hydraulic fluid is being displaced from the other portion 60*b* of chamber means 60 on the other side of piston means 44 and through four-way valve means 82 to reservoir 92. In its second position (see FIG. 3) four-way valve means 82 communicates pressurized hydraulic fluid between source means 80 and second port means 64. Additionally, communication is permitted between first port means 62 and the reservoir 92. Therefore, fluid is admitted into the chamber portion 60*b* and displaced from the chamber portion 60*a*.

Preferably, to prevent too rapid of a movement of rod means 42, the speed at which piston means 44 moves is controlled. As chamber means 60 has a rather large effective area, a substantial volume of hydraulic fluid is admitted into and simultaneously displaced from chamber means 60 during movement of piston means 44. One manner of controlling the speed of movement for piston means 44 is to control the flow rate of fluid being displaced from chamber means 60. That flow rate may be controlled by providing a sized orifice 90*a* in conduit 90 between four-way valve means 82 and reservoir 92.

Coupling means 46 selectively renders rod means 42 movable in response to movement of piston means 44. However, since piston means 44 is disposed in chamber means 60 and is inaccessible to coupling means 46, means 94 associated with piston means 44 extend out of chamber means 60. Such means 94 may comprise a cylinderical member 94 extending from piston means 44 out of cylinder means 60. Coupling means 46 coacts with the member 94 to render rod means 42 movable with piston means 44. The upper end portion 94*a* of member 94 coacts with and receivs coupling means 46. The end portion 94*a* includes slot means 96 sized to receive coupling means 46. When received with slot means 96, coupling means 46 can engage rod means 42 and render rod means 42 movable in response to movement of piston menas 44. However, when coupling means 46 is not received within slot means 96, piston means 44 may move without moving rod means 42. An aperture 94*b*, extending longitudinally through the upper end portion 94*a*, is sized so that rod means 42 may pass therethrough. Therefore, when coupling means 46 is not disposed in slot means 96, movement of piston means 44 does not result in corresponding movement of rod means 42. Instead, rod means 42 may be held stationary in a position extending through the aperture 94*b*. Movement of piston means 44 would then not tend to move rod means 42.

Rod means 42 is moved longitudinally through the lubricator 24 to move well equipment 34 through flow path 50 of the well flow conductor 38. One end of rod means 42 includes means for connecting well equipment 34 thereto. This connecting means 98 may be the threads shown.

Rod means 42 comprises a plurality of segments, two of which are shown at 42*a* and 42*b*. For the rod means 42 shown, one segment 42*a* is the well equipment handling segment. It includes the connecting means 98 for connecting the rod means 42 to the well equipment 34. The other segment 42*b* is a reach segment. During operation of the lubricator 24, additional reach segments 42*b* will be connected to and form a portion of rod means 42. In such manner, the distance through which rod means 42 moves well equipment 34 is increased as desired. Additional reach segments for rod means 42 could be formed similar or identical to the illustrated reach segment 42*b;* preferably addition segments are identical to segment 42*b*.

All of the rod segments may be readily interconnected and disconnected. The means for connecting one rod segment to another is the same for any two rod segments which will be interconnected. As illustrated, for the rod segments 42*a* and 42*b*, each segment may have identical female threaded connecting means 100*a* and 100*b* at one end thereof. The reach segments 42*b* would then all have a complementary, identical male threaded connecting means 102 which can threadedly engage any one of the female threaded connecting means 100. To interconnect the reach segment 42*b* with the equipment handling segment 42*a*, the male threads 102 of the reach segment 42*b* are threaded into the female threads 100*a* of the segment 42*a*. In a similar manner, an additional reach segment may be interconnected to segment 42*b*.

Rod means 42 includes a plurality of means engageable by coupling means 46. Each of the rod segments includes at least one such means. The engageable means 104 are spaced along the rod means 42. The distance between adjacent engageable means 104 is no greater than the distance between the first and second extreme positions of piston means 44. Thus, rod means 42 may be held stationary while coupling means 46 is disengaged from one engageable means 104 and piston means 44 is moved between its first and second extreme positions. Coupling means 46 may thereafter be engaged with another engageable means 104. As illustrated in the drawings, the engageable means 104 may be an annular recess 104 formed in each segment of rod means 42. For rod segment 42*a*, the annular recess is designated as 104*a;* for rod segment 42*b*, it is designated 104*b*.

The engageable means 104 are preferably spaced along rod means 42 so that a single stroke of piston means 44 will move rod means 42 a distance substantially equal to the length of one reach segment 42*b*. For example, when piston means 44 is in the FIG. 2A position, coupling means 46 may engage recess means 104*a*. Movement of piston means 44 to the FIG. 3 position, permits coupling means 46 to engage recess means 104*b*. Thereafter, when piston means 44 is returned to the FIG. 2A position, rod means 42 is moved a distance substantially equal to the length of rod segment 42*b*.

Figure 4:
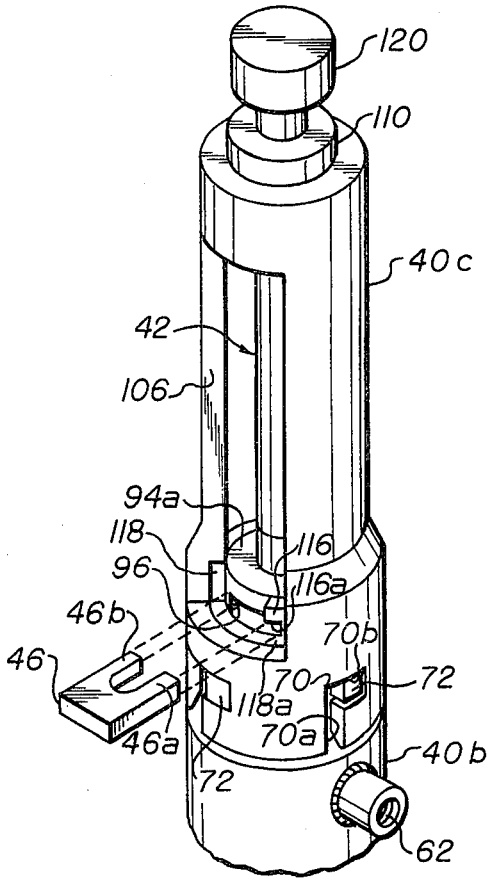
FIG. 4 is a perspective view of a portion of the lubricator.
Figure 5:
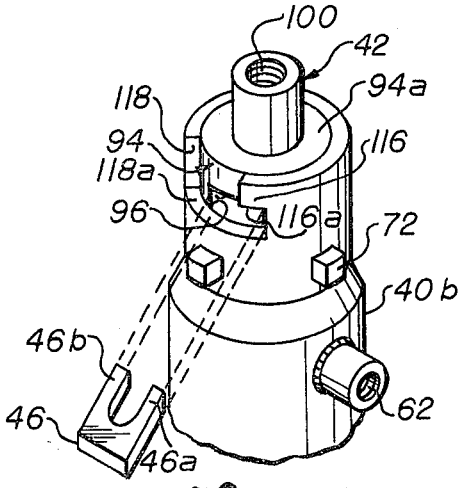
FIG. 5 is a perspective view similar to that of FIG. 4 showing the lubricator with its rod support portion removed.

Coupling means 46 is selectively engagable with rod means 42 and renders rod means 42 movable in response to movement of piston means 44. As best seen in FIGS. 4 and 5, coupling means 46 may comprise a substantially U-shaped lug. The thickness and width of the lug permit it to be inserted into slot means 96. The legs 46*a* and 46*b* of coupling means 46 are spaced apart and are adapted to be received within recess means 104 to thereby engage rod means 42. When coupling means 46 is inserted into slot means 96, with its legs 46*a* and 46*b* received within recess means 104, rod means 42 and piston means 44 are coupled together. Neither can move without corresponding movement of the other.

It will be noted that coupling means 46 does not include a handle or an extension. Therefore when forces are applied to piston means 44 and rod means 42, it will be exceedingly difficult to inadvertently extract coupling means 46 from slot means 96 and recess means 104. Should coupling means 46 become inadvertently disengaged from recess means 104, well fluids could force rod means 42 to extrude from the well flow conductor 38. Depending upon the number of interconnected segments forming rod means 42, uncontrolled extrusion of the rod means 42 could have disastrous consequences. For example, rod means 42 could rupture a wall of the work chamber 14 or injure personnel therein.

To permit the manipulation of coupling means 46 and the interconnection of reach segments 42*b* to, and their disconnection from, rod means 42, housing section 40*c* includes longitudinally extending window means 106. Window means 106 extends for substantially the entire length of housing section 40*c* and is longer than the length of a single reach segment 42*b*. When piston means 44 is in its first position (see FIG. 2A) a reach segment 42*b* may be manipulated. Such manipulation may be to disconnect the segment 42*b* from rod means 42 and remove it from within the lubricator housing means 40 through window means 106. Conversely, a reach segment 42*b* may be inserted into housing means 40 through window means 106 and thereafter joined to rod means 42. In either extreme position of piston means 44, coupling means 46 may be manipulated to either extract it from slot means 96 or insert it into slot means 96. Window means 106 is sized to permit that manipulation. If desired, coupling means 46 could project out of slot means 96. Window means 106 would then be sized so that piston means 44 could move between its extreme positions without coupling means 46 engaging housing section 40*c*.

Selectively operative stop means prevent uncontrolled extrusion of rod means 42. To positively prevent rod extrusion, two selectively operable stop means are provided. Depending upon the sequential operating position of the lubricator 24, one of these stop means can be rendered operative to prevent uncontrolled extrusion of rod means 42.

The first stop means prevents rod means 42 from extruding out of the housing section 40*c*. This first stop means is carried by the housing section 40*c* and may comprise the inwardly and downwardly facing end surface 108 of stop nut means 110. Stop nut means 110 includes outer threads 112. The threads 112 permit stop nut means 110 to be easily threaded into and out of the correspondingly threaded bore 114 of the housing section 40*c*. The precise position of the stop surface 108 relative to the housing section 40*c* may therefore be adjusted by advancing stop nut means 110 with respect to the thread 114. When stop nut means 110 is screwed into the threaded bore 114 and housing section 40*c* is connected to the remaining portion of the lubricator 24, stop nut means 110 will prevent rod means 42 from extruding out of the housing section 40*c* regardless of whether or not coupling means 46 is engaging recess means 104.

However, stop nut means 110 may not always be effective to prevent extrusion of rod means 42. At certain times, the housing section 40*c* may be removed from the lubricator 24. At other times, stop nut means 110 may be removed from the housing section 40*c*. Therefore, a second selectively operable stop means is provided. It can be rendered effective either before or after the first selectively operable stop means is rendered ineffective.

The second selectively operable stop means (see FIGS. 4 and 5) is associated with the housing section 40b. It can be rendered operative even when the housing section 40c is removed. It may be selectively engaged by coupling means 46. Thereafter, the second stop means prevents longitudinal movement of coupling means 46, rod means 42 and piston means 44 until coupling means 46 is disengaged therefrom. The illustrated second stop means comprises finger means 116 formed on housing section 40b. The upper end of housing section 40b includes a cut-out portion 118 which is aligned with window means 106 when housing section 40c is connected to the remaining portion of the lubricator 24. The cut-out portion 118 permits complete movement of piston means 44 to the FIG. 2A position before coupling means 46 is engaged by housing section 40b. Coupling means 46 can pass by finger means 116 during longitudinal movement of piston means 44. However, when desired, the coupling means 46 may be moved laterally slightly, by rotating rod means 42, so that a portion thereof becomes engaged under the downwardly facing shoulder 116a of the projecting finger means 116. The shoulder 116a and the upwardly facing surface 118a of cut-out 118 then prevent longitudinal movement of coupling means 46, rod means 42 and piston means 44.

Even if piston means 44 fails and neither of the stop means are rendered operable, with coupling means 46 coupling the movement of rod means 42 and piston 44, the distance which rod means 42 can extrude is limited to a single stroke of piston means 44. That distance is approximately 18 inches.

Means for holding rod means 42 and for manipulating rod segments 42b are associable with the housing means 40. Whenever the lubricator 24 is positioned vertically on a well flow conductor 38, rod means 42 could drop through the flow passage means 50 under the influence of gravity. Holding means 120 prevents rod means 42 from dropping. Holding means 120 additionally manipulates reach rod segments 42b so that they may be added to or removed from rod means 42. The holding and manipulating means 120 includes a stem portion 120a sized to extend through a bore 122 formed in the stop nut means 110. At the end of the stem portion 120a are formed means 120b for engaging and holding rod means 42 or a rod segment. The means 120b may comprise the male threads 120b shown. The threads 120b are complementary to the female threads 100 of each rod segment. They are, therefore, identical to the threads 102 of the reach segments 42b. To manipulate the means 120, and a rod segment when it is attached thereto, the handling and manipulating means 120 includes a knob portion 120c. The knob portion 120c cannot pass through the bore 122 of stop nut means 110.

In operation, the lubricator 24 of this invention is utilized to move well equipment through a well flow conductor.

For example, a well tool 36, such as a well plug structured in accordance with the disclosure of the aforementioned application Ser. No. 786,380, would have previously been landed, locked and sealed in the well flow conductor 38. The lubricator 24 will move the retrieval equipment 34, also structured in accordance with the disclosure of application Ser. No. 786,380, through the flow conductor 38 to retrieve the plug 36.

The tool 36 would have been installed prior to removal of the underwater blowout preventer stack. The tool or plug 36 maintains the well under control until suitable valves or a tree can be installed. It also prevents sea water from entering the well after the underwater blowout preventer stack has been removed. During assembly of an underwater production wellhead, a tree 22 is lowered to the upstanding casing head 20 and attached thereto. A work chamber 14 is formed around the tree 22. Sea water is evacuated from the work chamber 14. Personnel are admitted thereto, to complete assembly of the underwater production wellhead, through hatch 18.

While the well tool 36 is in the flow conductor 38, the tree 22 is flanged to the tubing head (not shown). Thereafter, pressures are preferably equalized across the tool 36. The tool 36 can be retrieved from the well flow conductor 38 utilizing the retrieval equipment 34 and lubricator 24.

During the retrieval operation, the valves of the tree 22 will be opened so that the retrieval equipment 34 can move therethrough. Once the retrieval equipment 34 has engaged the well tool 36 and has unlocked it from the flow conductor 38, the tool 36 is no longer effective to confine well fluids. The lubricator 24 thereafter withdraws the retrieval equipment 34 and plug 36 through the flow conductor 38. After the plug 36 has been moved sufficiently, a valve of the tree 22 can be closed below it. Well fluids are bled from the lubricator 24. The lubricator 24 can then be removed from the wellhead.

As illustrated in FIG. 2B, the retrieval equipment 34 must pass through a tree valve 22a prior to reaching the well tool 36. The valve 22a may be the top valve of the tree 22. The lubricator 24 will be joined to the tree 22 above the valve 22a. Between the lubricator 24 and valve 22a will be connected a blowout preventer 124. The blowout preventer 124 will be closed to seal around rod means 42 in the event that well fluids attempt to escape from the well flow conductor 38 during operation of the lubricator 24. The blowout preventer 124 may be a Hydril type "GKS" wire-line stripper and blowout preventer illustrated on pages 3348 and 3349 on the "COMPOSITE CATALOG OF OILFIELD EQUIPMENT AND SERVICES" 1976–77 edition. The height of such a blowout preventer is relatively short. When size and space limitations are important, utilizing equipment that is relatively short is advantageous.

A connector 126 connects the blowout preventer 124 and valve 22a. The connector 126 may be an Otis Quick Union as illustrated on page 3984 of the "COMPOSITE CATALOG OF OILFIELD EQUIPMENT AND SERVICES" 1974–75 edition.

A connector 128 connects the lubricator 24 to the blowout preventer 124. The connector 128 may also be an Otis Quick Union.

Prior to connecting the lubricator 24 in communication with the well flow conductor 38, the retrieval equipment 34 is attached to rod means 42.

Assume that the equipment handling section 42a of rod means 42 is coupled for movement with piston means 44 by coupling means 46 (e.g., coupling means 46 is engaging recess means 104a). To render the equipment connecting means 98 of rod means 42 accessible, piston means is moved to the FIG. 2A position. To do so, four-way valve means 82 is moved to its first position. Hydraulic fluid from source means 80 pressurizes the chamber portion 60a. Piston means 44 is moved thereby. The retrieval equipment 34 may then be connected to the threaded connecting means 98 of rod section 42*a*.

The lubricator 24 may now be connected to the respective well installation such as by connecting it to the blowout preventer 124. The connector 128 is made up with the threads 52 of lubricator housing means 40. Bore means 48 through lubricator housing means 40 is aligned with the flow path 50 through the well flow conductor 38. The tree valves may be opened so that the retrieving equipment 34 and lubricator rod means 42 may pass therethrough.

The housing support section 40*c* is connected to housing section 40*b*. To do so, the longitudinally extending portion 70*a* of the L-slot means 70 are aligned with the lugs 72. The housing support section 40*c* is moved longitudinally towards the housing section 40*b* until the lugs 72 become aligned with the circumferentially extending portion 70*b* of the L-slot means 70. The housing section 40*c* is rotated. The lugs 72 become disposed within the circumferentially portions 70*b* of L-slot means 70. Housing support section 40*c* is thereby joined to the remaining portion of the lubricator housing means 40.

At this time, a reach segment 42*b* may be added to the equipment handling segment 42*a*. Additional segments 42*b* may be added to rod means 42 in either of two ways. The first method is utilized whenever space limitations inside the work chamber are such that the handling and manipulating means 120 is in close proximity to the interior wall of the work chamber 14. The second method may be utilized whenever there is approximately 24 inches between the interior wall of the work chamber 14 and the upper end of the lubricator 24. The first method is preferred as less space is required.

In accordance with the first method of adding rod segments 42*b*, the rod segments 42*b* are inserted into housing means 40 through window means 106. A rod segment 42*b* may be added to rod means 42 when piston means 44 is in its first extreme (FIG. 2A) position. Coupling means 46 will be received within slot means 96 and will be engaging a recess means 104. Coupling means 46 will thereby maintain that portion of rod means 42 which is already formed and disposed within housing means 40 longitudinally stationary. Generally, the handling and manipulating means 120 will be withdrawn from the bore 122 of stop nut means 110. Stop nut means 110 is unscrewed a distance approximately equal to the length of the thread 100*b* of the rod connecting means. A reach segment 42*b* is inserted through window means 106 into housing means 40. The male connecting means 102 of the added reach segment 42*b* is made up with the female connecting means 100*a* of the original rod means 42. After this connection has been made up, stop nut means 110 is screwed inwardly until its surface 108 engages the upstanding end of rod means 42. The threads 120*c* of holding and manipulating means are made up the threads 100*b* of rod means 42 to hold rod means longitudinally stationary. Thereafter, the lubricator 24 is operated to move rod means 42 and the attached well equipment 34 through the flow conductor 38.

In accordance with the second method of adding rod segments 42*b* to the rod means 42, the segment 42*b* to be added is inserted into the lubricator housing means 40 through bore 114. Prior to adding a segment in this manner, piston means 44 is moved to its first position. Coupling means 46 is inserted into slot means and engages recess means 104. Preferably, rod means 42 is rotated slightly so that coupling means 46 becomes lodged under the surface 116*a* of finger means 116. Longitudinal movement of rod means 42 is thereby prevented. Stop nut means 110 may now be safely unscrewed and removed from threaded bore 114. The stem portion 120*a* of holding means 120 is inserted through the bore 122 of stop nut means 110. The male threads 120*c* of the holding means 120 engage and make up with the female threads 100*b* of a reach segment 42*b*. The reach segment 42*b* is inserted through the bore 114. Stop nut means 110 is rotated so that its threads 112 engage the threads within the bore 114. At the same time, the holding and manipulating means 120 is rotated. The male threaded connecting means 102*b* of the reach segment 42*b* makes up with the female threaded connecting means 100*a* of the equipment handling segment 42*a*. The lubricator 24 is now in the position illustrated in FIG. 2A.

Once the lubricator 24 in in the FIG. 2A position, coupling means 46 may be safely withdrawn from recess means 104 and slot means 96. Rod means 42 will remain held in the position illustrated. The surface 108 of stop nut 110 prevents the rod means 42 from being extruded out of the lubricator due to the force of pressurized well fluids within the flow path 50. The holding and manipulating 120 prevents rod means 42 from dropping into the flow path under the influence of gravity.

The lubricator 24 is operated to move the well equipment 34 through the well flow conductor 38. During the operation, piston means 44 undergoes multiple strokes and the length of rod means 42 is increased by interconnecting additional segments 42*b* thereto. Piston means 44 is moved in one direction to vary the point along rod means 42 where coupling means 46 is engaged. Piston means 44 is moved in another direction to move rod means 42 and well equipment 34.

For example, once the lubricator is in the FIG. 2A configuration, piston means 44 cannot move rod means 42 and the equipment 34 downwardly. The lubricator 24 will first have to assume the configuration of FIG. 3.

The holding means 120 and stop nut means 110 will retain rod means 42 longitudinally stationary while the piston means 44 is moved to the FIG. 3 position. Prior to moving piston means 44, coupling means 46 is withdrawn from recess means 104 and slot means 96. Four-way valve is rotated from its first position to its second position. Pressurized hydraulic fluid from source means 80 is admitted to chamber portion 60*b* through second port means 64. At the same time, hydraulic fluid is displaced from the other chamber portion 60*b* to reservoir 92. Under the action of the pressurized hydraulic fluid, piston means 44 moves to the FIG. 3 position. Coupling means 46 is reinserted into slot means 96 until it engages recess means 104*b*. The lubricator 24 is now in the position illustrated in FIG. 3. To permit coupled movement of piston means 44 and rod means 42, the holding means 120 is disconnected from the reach segment 42*b*. Piston means 44 may then be moved from the FIG. 3 position to the FIG. 2A position. To move piston means 44, four-way valve means 82 is rotated back to its first position. Pressurized hydraulic fluid from source means 80 enters chamber portion 60*a* through port means 62. Simultaneously, fluid is displaced from chamber portion 60*b* through second port means 64 and routed to reservoir 92. Piston means 44 moves between its FIG. 3 position and its FIG. 2A position. Rod means 42 moves therewith.

If, during the movement of piston means 44 from the FIG. 3 position to the FIG. 2A position, the retrieval equipment 34 reaches the landed well tool 36, the retrieval equipment 34 is manipulated to unlatch the tool 36. If, however, the retrieval equipment 34 does not move a distance sufficient to reach the landed tool 36, an additional reach segment is added to rod means 42. The lubricator 24 is then operated so that piston means 42 moves the lengthened rod means 42. The well equipment 34 is thereby moved further into the well flow conductor 38. If necessary, still additional reach segments are added to rod means 42. The well equipment 34 is moved by the lengthened rod means 42 any desired distance through the well flow conductor.

Once piston means 44 reaches the FIG. 2A position, if an additional segment **42*b* is to be added to rod means 42, the rod means 42 is preferably maintained longitudinally stationary while an additional segment 42*b* is being added thereto. Coupling means 46 may be rotated slightly so that it becomes disposed under the projecting finger means 116. Coupling means 46 remains engaged with the recess means 104 of rod means 42. Coupling means 46 is also confined by the downwardly facing surface 116*a* of finger means 116 and the upwadly facing bottom surface 118*a* of cut-out 118. Rod means 42 cannot extrude from the lubricator 24 or drop downward therein. An additional rod segment 42*b* may be added to the rod means 42** as previously explained.

Once the well equipment 34 reaches the landed and locked well tool 36, the well equipment 34 is manipulated to retrieve the tool 36. The equipment is manipulated by manipulating the rod means 42 with piston means 44. The retrieval of the tool 36 by the equipment 34 is more fully explained in the aforementioned application Ser. No. 786,380. As explained in that application, the prong **34*a* of the retrieval equipment 34 engages and moves the equalizing valve means 36*a* of the tool 36 in a position opening the tool's equalizing flow passage means 36*b*. The collet 34*b* urges the prong 34*a* outwardly until the prong 34*a* engages the tool's fishing neck recess 36*c*. Pressures are equalized across the tool 36. An upward application of force to the retrieval equipment 34 will then unlatch the tool 36 from the well flow conductor 38. The tool 36 may thereafter be retrieved upwardly through the well flow conductor 38**.

Upon opening of the tool's equalizing flow passage means **36*b*, high pressure well fluids from below the tool 36, which had been confined, are now admitted up to the bore 48 of the lubricator 24. Packing means 54 prevents these well fluids from escaping through the lubricator 24. Gauge means 68 is monitored to verify that the equalizing passage means 36*b* has in fact been opened and that pressures have in fact been equalized across the tool 36**.

Once it is verified that the equalizing passage means **36*b* is open and that the pressures are equalized, upward forces are applied to rod means 42 to retrieve the well tool 36 from the well flow conductor 38. The lubricator 20 is operated substantially in reverse to the manner previously described to withdraw the tool 36 from the well flow conductor 38**.

During upward retrieval of the well equipment 36, piston means 44 undergoes multiple strokes and rod means 42 is shortened. Segments **42*b* are removed from rod emans 42 substantially in reverse to the manner in which they were added to rod means 42**.

Preferably, as soon as the tool 35 had been moved a distance sufficient to position the tool 36 above a valve **22*a* of the tree 22, the valve 22*a* is closed. Well fluids in the flow conductor are then confined by the valve 22*a*. Fluid within the bore 48 of the lubricator 24 is bled off. The lubricator 24 may now be disconnected from the well installation by disconnecting connector 128**.

Thus, the reach of the lubricator 24 is not limited to the stroke of piston means 44. During operation of the lubricator 24, as many reach segments **42*b* as desired may be made up to form rod means 42. The reach of the lubricator 24 is increased with each reach rod segment 42*b* joined to rod means 42. During operation of the lubricator 24, rod means 42 is prevented from extruding from the lubricator 24 and the well flow conductor. Even if piston means 44 fails and rod means 42 does attempt to extrude from the lubricator 24,the extrusion will be stopped. If segments 42*b* are being inserted and removed through window means 106, stop nut means 110 will be operable. The extrusion of rod means 42 will be stopped by the engagement of the upstanding end of rod means 42 with the surface 108 of stop nut means 110. If segments 42*b* are being inserted and removed through bore 114, extrusion of rod means will stop whenever piston means 44 reaches its FIG. 3 position. Coupling means 46, by engaging recess means 104, will prevent further extrusion of rod means 42. At most, only one rod segment 42*b* will be extruded through the bore 114. Since, for such an extrusion to occur, the rod segments were being inserted through the bore, there will be enough space within the chamber 14 for one segment to extrude without endangering the integrity of the chamber 14**.

Eventhough the lubricator 24 is relatively short when compared with previous lubricators, as can be seen in FIG. 1, the lubricator 24 may interfere with the closing of hatch 18. If it is desired to close the hatch 18, the lubricator 24 may be shortened. To shorten the lubricator 24, piston means 44 is moved to the FIG. 2A position. Coupling means 46 is moved laterally slightly, by rotating rod means 42, to lodge a portion thereof under projecting finger means 116. The rod segment **42*b* which extends into the housing support section 40*c* is disconnected from the rod means 42 and withdrawn from the section 40*c*. The housing support section 40*c* is rotated. The lug means 72 becomes aligned with the longitudinally extending portions 70*a* of L-slot means 70. The housing sectin 40*c* is lifted off of the remaining portion of the lubricator. The upper end of the shortened lubricator 24 is illustrated in perspective, in FIG. 5**.

From the foregoing, it can be seen that the objects of this invention have been attained. The lubricator is capable of moving well equipment through a well flow conductor. The lubricator is a rod-type lubricator. Its rods positively move the well equipment through the flow conductor in response to movement of a lubricator piston. However, the amount of movement which may be imparted to the well equipment is not limited to the stroke of the piston. As many reach rod segments as desired may be added to the lubricator rod to increase the amount of movement imparted to the well equipment. The lubricator piston undergoes multiple strokes to permit the addition of additional reach rod segments. The piston is moved in one direction to move the rod and attached equipment into the flow conductor. The piston is moved in another direction to change the location where the rod is coupled to the piston. The rod is held longitudinally stationary while it is not rendered movable with the piston. The rod is thereby prevented from extruding due to the force of well fluids within the well flow conductor or dropping into the well flow conductor under the force of gravity. If desired, the lubricator may be partially disassembled. While partially disassembled, the lubricator rod is again prevented from extruding or falling. The partial disassembly further shortens the overall length of the lubricator.

The foregoing description and disclosure of the invention is illustrative and explanatory thereof. Various changes in the size, shape, and materials, as well as in the details of the illustrated construction, may be utilized within the scope of the appended claims without departing from the spirit of the invention.

What is claimed is:

1. A lubricator for moving well equipment through a well flow conductor, the lubricator comprising:
housing means including chamber means and longitudinally extending bore means;
piston means disposed in said chamber means;
said piston means being movable to a first position upon pressurization of one portion of said chamber means and being movable to a second position upon pressurization of another portion of said chamber means;
rod means movable through said bore means and including a plurality of segments adapted to be interconnected and disconnected;
coupling means;
each of said rod means segments including at least one means engageable by said coupling means with the distance between adjacent engageable means being not greater than the distance between said first and second positions of said piston means;
means associated with said piston means and extending out of said chamber means;
said coupling means being adapted to engage both of said engageable means of said rod means and said means associated with said piston means for rendering said rod means longitudinally movable in response to movement of said piston means;
selectively operable stop means for selectively preventing movement of said rod means with respect to said housing means when such movement is not controlled by movement of said piston means and for limiting movement of said rod means in one direction in the event movement of said rod means can not be controlled by said piston means.

2. The lubricator of claim 1 wherein said selectively operable stop means includes:
finger means formed on said housing means and adapted to be engageable by said coupling means when said coupling means has engaged both of said engageable means of said rod means and said means associated with said piston means and when said piston means is in one of said first position and said second position; and
wherein once said finger means has engaged said coupling means further movement of said rod means is prevented until said coupling means disengages from said finger means.

3. A lubricator for moving well equipment through a well flow conductor, the lubricator comprising:
housing means including chamber means and longitudinally extending bore means;
piston means disposed in said chamber means;
said piston means being movable to a first position upon pressurization of one portion of said chamber means and being movable to a second position upon pressurization of another portion of said chamber means;
rod means movable through said bore means and including a plurality of segments adapted to be interconnected and disconnected;
coupling means;
each of said rod means segments including at least one means engageable by said coupling means with the distance between adjacent engageable means being not greater than the distance between said first and second positions of said piston means;
means associated with said piston means and extending out of said chamber means;
said coupling means being adapted to engage both of said engageable means if said rod means and said means associated with said piston means for rendering said rod means longitudinally movable in response to movement of said piston means;
selectively operable stop means for preventing movement of said rod means with respect to said housing means when such movement is not controlled by movement of said piston means; and
wherein said selectively operable stop means includes:
stop nut means adapted to selectively project through said housing means and provide a stop surface; and
holding means, including means for connecting said holding means to said rod means, for holding said rod means in a position engageable with said stop surface.

4. A lubricator for moving well equipment through a well flow conductor, the lubricator comprising:
housing means including chamber means and longitudinally extending bore means;
piston means disposed in said chamber means;
said piston means being movable to a first position upon pressurization of one portion of said chamber means and being movable to a second position upon pressurization of another portion of said chamber means;
rod means movable through said bore means and including a plurality of segments adapted to be interconnected and disconnected;
coupling means;
each of said rod means segments including at least one means engageable by said coupling means with the distance between adjacent engageable means being not greater than the distance between said first and second positions of said piston means;
means associated with said piston means and extending out of said chamber means;
said coupling means being adapted to engage both of said engageable means of said rod means and said means associated said piston means for rendering said rod means longitudinally movable in response to movement of said piston means;
selectively operable stop means for preventing movement of said rod means with respect to said housing means when such movement is not controlled by movement of said piston means; and
wherein said selectively operable stop means includes:
finger means formed on said housing means and adapted to be engageable by said coupling means when said coupling means renders said rod means movable with said piston means;

stop nut means adapted to selectively project through said housing means and provide a stop surface; and holding means, including means for connecting said holding means to said rod means, for holding said rod means in a position engageable with said stop surface.

5. A lubricator for controlling movement of well equipment through a well flow conductor, the lubricator comprising:

housing means including chamber means and longitudinally extending bore means;

piston means disposed in said chamber means;

said piston means being movable to a first position upon pressurization of one portion of said chamber means and being movable to a second position upon pressurization of another portion of said chamber means;

rod means movable through said bore means and into the flow conductor and including a plurality of segments adapted to be interconnected and disconnected;

coupling means;

said housing means including a support section extending longitudinally away from said chamber means;

means associated with said piston means and extending out of said cylinder means and into said support section;

each of said rod means segments including at least one engageable means for said coupling means with the distance between adjacent engageable means being not greater than the distance between said first and second positions of said piston means;

said coupling means being adapted to engage both of said means associated with said piston means and said engageable means to render said rod means movable with said piston means;

selectively operable means for preventing longitudinal movement of said rod means;

said selective operable means being rendered operable to prevent longitudinal movement of said rod means while said coupling means is disengaged from one of said engageable means and said piston means is moved between its first and second positions and thereafter permitting longitudinal movement of said rod means into the flow conductor in response to movement of said piston means and continuously being effective to limit movement of said rod means in one direction in the event that movement of said rod means can not be controlled by said piston means.

6. The lubricator of claim 5 wherein:

said housing support section is selectively disengageable from the remaining portion of said housing means; and said selectively operable means includes finger means on the remaining portion of said housing means and engageable by said coupling means when said coupling means has engaged both of said means associated with said piston means and said engageable means and when said piston means is in one of said first position and said second position; and wherein once said finger means has engaged said coupling means further movement of said rod means is prevented even when said housing support means portion is disengaged from the remaining portion of said housing means.

7. The lubricator of claim 5 wherein:

one of said rod means segments comprises a well equipment handling segment and includes:

means for attaching well equipment to said segment, and means for connecting said segment to another of said rod means segments;

other of said rod means segments comprise reach segments and include:

connecting means complementary to the connecting means of said well equipment handling segment for connecting said reach rod segments to any of said rod means segments, and connecting means similar to the connecting means of said well equipment handling segment.

8. A lubricator for controlling movement of well equipment through a well flow conductor, the lubricator comprising:

housing means including chamber means and longitudinally extending bore means;

piston means disposed in said chamber means;

said piston means being movable to a first position upon pressurization of one portion of said chamber means and being movable to a second position upon pressurization of another portion of said chamber means;

rod means movable through said bore means and into the flow conductor and including a plurality of segments adapted to be interconnected and disconnected;

coupling means;

said housing means including a support section extending longitudinally away from said chamber means;

means associated with said piston means and extending out of said cylinder means and into said support section;

each of said rod means segments including at least one engageable means for said coupling means with the distance between adjacent engageable means being not greater than the distance between said first and second positions of said piston means;

said coupling means being adapted to engage both of said means associated with said piston means and said engageable means to render said rod means movable with said piston means;

selectively operable means for preventing longitudinal movement of said rod means;

said selective operable means being rendered operable to prevent longitudinal movement of said rod means while said coupling means is disengaged from one of said engageable means and said piston means is moved between its first and second positions and thereafter permitting longitudinal movement of said rod means into the flow conductor in response to movement of said piston means; and wherein said selectively operable means includes:

stop nut means adapted to cooperate with said housing support section and to provide a stop surface engageable by said rod means;

holding means adapted to be connected to said rod means and hold said rod means in abutment with said stop surface to thereby prevent said rod means from moving longitudinally with respect to said housing means.

9. A lubricator for controlling movement of well equipment through a well flow conductor, the lubricator comprising:

housing means including chamber means and longitudinally extending bore means;

piston means disposed in said chamber means;

said piston means being movable to a first position upon pressurization of one portion of said chamber means and being movable to a second position upon pressurization of another portion of said chamber means;

rod means movable through said bore means and into the flow conductor and including a plurality of segments adapted to be interconnected and disconnected;

coupling means;

said housing means including a support section extending longitudinally away from said chamber means;

means associated with said piston means and extending out said cylinder means and into said support section;

each of said rods means segments including at least one engageable means for said coupling means with the distance between adjacent engageable means with the distance between adjacent engageable means being not greater than the distance between said first and second positions of said piston means;

said coupling means being adapted to engage both of said means associated with said piston means and said engageable means to render said rod means movable with said piston means;

selectively operable means for preventing longitudinal movement of said rod means;

said selective operable means being rendered operable to prevent longitudinal movement of said rod means while said coupling means is disengaged from one of said engageable means and said piston means is moved between its first and second positions and thereafter permitting longitudinal movement of said rod means into the flow conductor in response to movement of said piston means;

wherein said housing support section is selectively disengageable from the remaining portion of said housing means;

said selectively operable means includes finger means on the remaining portion of said housing means and adapted to be engageable by said coupling means for preventing longitudinal movement of said rod means when said housing support means portion is disengaged from the remaining portion of said housing means; and said selectively operable means additionally included:

stop nut means adapted to cooperate with said housing support section and to provide a stop surface engageable by said rod means, and holding means adapted to be connected to said rod means and hold said rod means in abutment with said stop surface to thereby prevent said rod means from moving longitudinally with respect to said housing means.

10. A lubricator for controlling movement of well equipment through a well flow conductor, the lubricator comprising:

housing means including chamber means and longitudinally extending bore means;

piston means disposed in said chamber means;

said piston means being movable to a first position upon pressurization of one portion of said chamber means and being movable to a second position upon pressurization of another portion of said chamber means;

rod means movable through said bore means and into the flow conductor and including a plurality of segments adapted to be interconnected and disconnected;

coupling means;

said housing means including a support section extending longitudinally away from said chamber means;

said support section being normally connected to the remaining portion of said housing means and being disconnectable from the remaining portion of said housing means;

means associated with said piston means and extending out of said cylinder means and into said support section;

each of said rod segments including at least one engageable means for said coupling means with the distance between adjacent engageable means being not greater than the distance between said first and second positions of said piston means;

said coupling means being adapted to engage both of said means associated with said piston means and said engageable means to render said rod means movable with said piston means;

stop nut means carried by said housing support section for limiting movement of said rod means in one direction;

finger means associated with the remaining portion of said housing means and engageable with said coupling means when said coupling means has engaged both of said means associated with said piston means and said engageable means and when said piston means is in one of said first and second positions to prevent movement of said rod means;

wherein once said finger means has engaged said coupling means, said housing support section may be disconnected from the remaining portion of said housing means with movement of said rod means prevented.

* * * * *

UNITED STATES PATENT OFFICE

CERTIFICATE OF CORRECTION

Patent No. 4,127,167 Dated November 28, 1978

Inventor(s) Henry P. Arendt

It is certified that error appears in the above-identified patent and that said Letters Patent are hereby corrected as shown below:

Column 2, line 20, "then" should read "than"

Column 5, line 9, "Guage" should read -- Gauge --.

Column 6, line 40, "receivs" should read "receives"

Column 6, line 45, "menas" should read "means"

Column 13, line 38, "in" should read "to"

Column 13, line 65, "emans" should read "means"

Column 14, line 46, "sectin" should read "section"

Column 17, line 56, cancel "and"

Column 19, line 23-24, cancel "with the distance between adjacent engageable means.

Signed and Sealed this

*Fifth* Day of *June 1979*

[SEAL]

*Attest:*

RUTH C. MASON
*Attesting Officer*

DONALD W. BANNER
*Commissioner of Patents and Trademarks*